US008784058B2

(12) United States Patent
Schneider et al.

(10) Patent No.: US 8,784,058 B2
(45) Date of Patent: Jul. 22, 2014

(54) ENGINE COOLING FAN HAVING DYNAMIC UNBALANCE COMPENSATION

(75) Inventors: Tobias Schneider, Ottersweier (DE); Markus Liedel, Pegnitz (DE); Thomas Helming, Baden-Baden (DE); Heidrun Schied, Rheinau (DE)

(73) Assignee: Robert Bosch GmbH, Stuttgart (DE)

( * ) Notice: Subject to any disclaimer, the term of this patent is extended or adjusted under 35 U.S.C. 154(b) by 727 days.

(21) Appl. No.: 13/062,739

(22) PCT Filed: Jul. 8, 2009

(86) PCT No.: PCT/EP2009/058669

§ 371 (c)(1),
(2), (4) Date: May 25, 2011

(87) PCT Pub. No.: WO2010/025976

PCT Pub. Date: Mar. 11, 2010

(65) Prior Publication Data

US 2011/0236211 A1 Sep. 29, 2011

(30) Foreign Application Priority Data

Sep. 8, 2008 (DE) ..... 10 2008 041 858

(51) Int. Cl.
*F04D 29/66* (2006.01)

(52) U.S. Cl.
USPC ..... 416/144; 416/169 A; 416/500

(58) Field of Classification Search
CPC ..... F04D 29/662
USPC ..... 416/144, 169 A, 500
See application file for complete search history.

(56) References Cited

U.S. PATENT DOCUMENTS

| | | | | |
|---|---|---|---|---|
| 1,032,729 | A * | 7/1912 | Baker | 416/144 |
| 6,213,717 | B1 * | 4/2001 | Bucher et al. | 416/145 |
| 7,025,570 | B2 | 4/2006 | Jung et al. | |
| 7,063,507 | B2 * | 6/2006 | Hsieh | 416/144 |
| 7,305,905 | B2 * | 12/2007 | Rocky et al. | 74/570.2 |
| 7,717,679 | B2 * | 5/2010 | He | 416/144 |
| 2008/0056899 | A1 | 3/2008 | Jiang et al. | |

FOREIGN PATENT DOCUMENTS

| | | | |
|---|---|---|---|
| DE | 202006010094 | U1 | 10/2006 |
| EP | 1500823 | A1 | 1/2005 |
| JP | 6210499 | | 1/1987 |
| JP | 471799 | | 6/1992 |
| JP | 6148019 | | 5/1994 |
| JP | 6317293 | | 11/1994 |
| JP | 2006322325 | | 11/2006 |
| WO | 02/97279 | A1 | 5/2002 |

OTHER PUBLICATIONS

PCT/EP2009/058669 International Search Report.

* cited by examiner

*Primary Examiner* — Ninh H Nguyen
(74) *Attorney, Agent, or Firm* — Michael Best & Friedrich LLP

(57) ABSTRACT

The invention relates to an engine fan device for a vehicle, characterized in that the engine fan device (10) has at least one or more receiving contours (24, 30, 50), in which one or more balancing elements (28) can be received, wherein at least one receiving contour (24) has at least two planes (26), and/or wherein at least two receiving contours (24) each have at least one plane (26), wherein both planes (26) are different from each other.

22 Claims, 7 Drawing Sheets

ENGINE COOLING FAN HAVING DYNAMIC UNBALANCE COMPENSATION

BACKGROUND OF THE INVENTION

The invention relates to an engine cooling fan of a motor vehicle, which is provided with a dynamic unbalance compensation device.

Inertial forces or static and dynamic unbalances are generally caused by uneven mass distributions of the rotating assemblies, such as the rotor or the armature of a motor and by the fan, for example, and by geometric and positional tolerances relative to the axis of rotation and the principal axis of inertia of the drive. The geometric and positional tolerances here mean that the axis of rotation and the principal axis of inertia do not coincide. In the event of a parallel shift between the axis of rotation and the principal axis of inertia of a cooling fan with fan wheel mounted on the rotor shaft this leads to a static unbalance, for example. If the axis of rotation is tilted relative to the principal axis of inertia, on the other hand, this produces a centrifugal moment, which is equivalent in its effects to a moment disequilibrium or dynamic unbalance.

A dynamic unbalance in engine cooling fans normally gives rise to mechanical oscillations. In this case the vibrations produced can penetrate into the passenger compartment and can not only cause a steering wheel to wobble, for example, but may also give rise to unwanted vibration noises. In addition the forces generated by the dynamic unbalance are justifiably suspected of sporadically giving rise to rapid bearing wear in engine cooling fan motors.

In modern engine cooling fans the static unbalance is generally compensated for in order to adhere to admissible limits. Compensating for the dynamic unbalance in fans which are often of a very flat construction, however, turns out to be a difficult and very intricate process.

SUMMARY OF THE INVENTION

According to the invention an engine fan device having an improved compensation for dynamic unbalance is now provided.

The engine fan device according to the invention for a vehicle in this case has at least one or more mounting contours for the mounting of one or more balancing elements, at least one mounting contour having at least two planes and/or at least two mounting contours forming at least two planes.

Such an engine fan device has the advantage of affording a simple and automatable facility for balancing out the dynamic unbalance and preventing the disadvantages occurring due to the unbalance. According to the invention one, two or more balancing elements, for example, are fixed or wedged and/or bonded in one or more mounting contours in order to compensate for a dynamic unbalance. The balancing elements here are dimensioned or have a predefined weight and are positioned in the mounting contours so that a dynamic unbalance can largely be prevented. At the same time one mounting contour, for example, has at least two planes for the arrangement of balancing elements. Alternatively or in addition multiple mounting contours each having just one plane may be provided, the planes of the mounting contours in this case being different, however, so that one plane is arranged higher or lower than the other plane, and/or one plane is arranged on a larger or smaller radius about the axis of rotation of the engine fan device than the other plane.

BRIEF DESCRIPTION OF THE DRAWINGS

Embodiments of the invention will be explained in more detail below with reference to the schematic figures of the drawing, in which.

DETAILED DESCRIPTION

Figure 1:
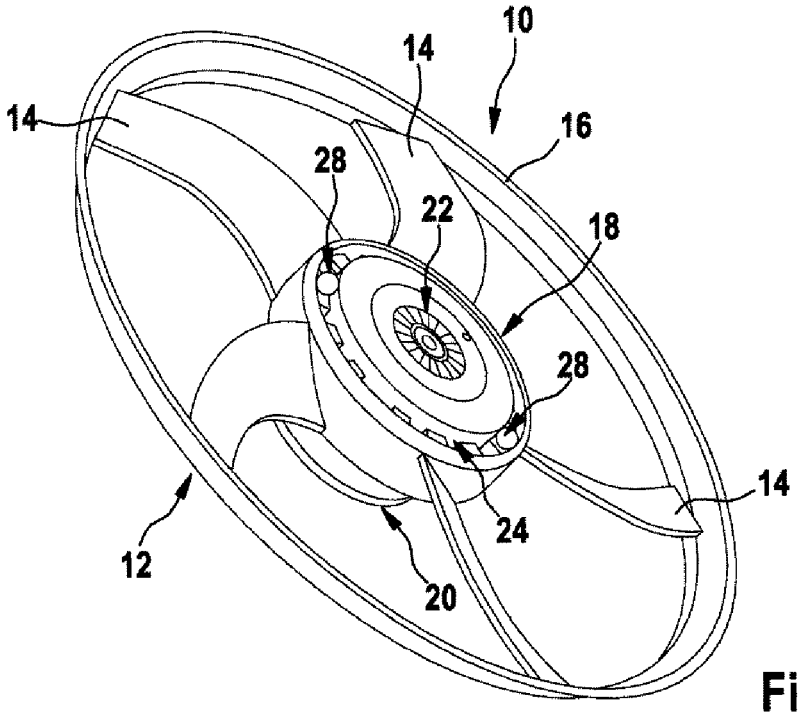
FIG. 1 shows a perspective view of an engine fan device according to a first embodiment of the invention.

Unless otherwise specified, the same elements and devices or ones fulfilling similar functions have been provided with the same reference numerals in all figures.

Figure 2:
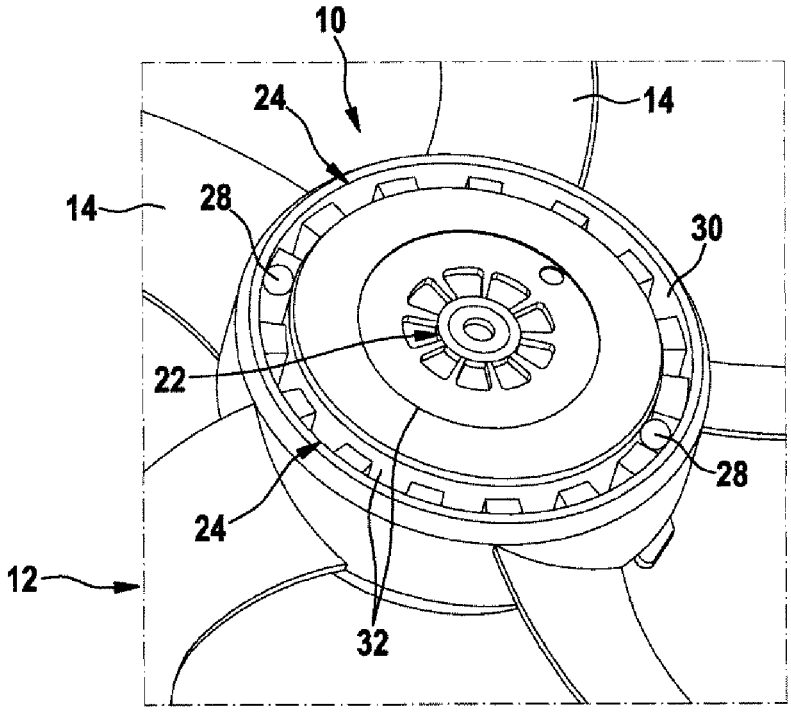
FIG. 2 shows a detail of the engine fan device according to FIG. 1.
Figure 3:
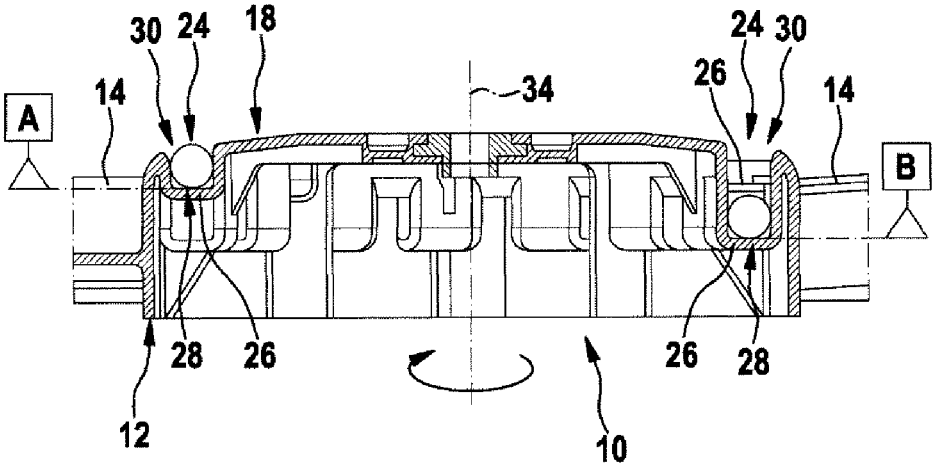
FIG. 3 shows a sectional view of the engine fan device according to FIG. 1.

FIGS. 1, 2 and 3 show a first embodiment of an engine fan device 10 according to the invention, in which a dynamic unbalance is compensated for. As is shown in FIG. 1, the engine fan device 10 here comprises a fan appliance 12, which comprises one or more blade elements 14, which on their outside are bounded by a fan wheel 16 and on their inside are molded onto a hub area 18 of the fan appliance 12, for example. The engine fan device 10 moreover comprises a motor 20 for driving the fan appliance 12. Here the fan appliance 12 may be coupled to the motor 20 by way of a drive carrier device 22, for example.

In order to compensate suitably for a dynamic unbalance of the engine fan device 10 and its fan appliance 12, the engine fan device 10 according to the first embodiment has a mounting contour 24, which has at least two, three or more planes 26, which are arranged on different levels. Here one, two, three or more balancing elements 28 can provided in the mounting contour 24. In this case the balancing elements 28 may be suitably positioned in the various planes 26 of the mounting contour 24, in order to counteract any dynamic unbalance. The mounting contour 24 here forms a circumferential groove 30, for example, which has a first plane 26 and which is also provided with additional depressions or mounts, which form the second plane 26, as is shown in FIGS. 1 and 2. The mounting contour 24 or groove 30 is concentrically arranged, for example, and due to the additional depressions 32 alternates between two planes of rotation 26. The mounting contour 24 or groove 30 may be provided merely over parts of the circumference, for example.

FIG. 3 shows a sectional view of the engine fan device according 10. The mounting contour 24 here is represented in the form of groove 30 and its two planes of rotation A and B. Here the mounting contour 24 is formed in the hub area 18 of the engine fan device 10, for example. At the same time the plane of rotation A is arranged higher than the plane of rotation B. Here two balancing elements 28 in the form of balls, for example, are provided in the depression 32 of the groove 30, one ball being located in the plane of rotation A and one ball in the plane of rotation B. In this way it is possible, for example, to counteract an unwanted tilting of the axis of rotation 34 relative to a principal axis of inertia and hence the formation of a dynamic unbalance as the fan appliance 12 rotates. The balancing elements 28 may be externally fixed in the mounting contour 24 or groove 30, for example by adhesive bonding and/or corresponding pre-tightening. The balancing elements 28 are furthermore of the same material or have the same material composition, the same weight and the same shape.

Figure 4:
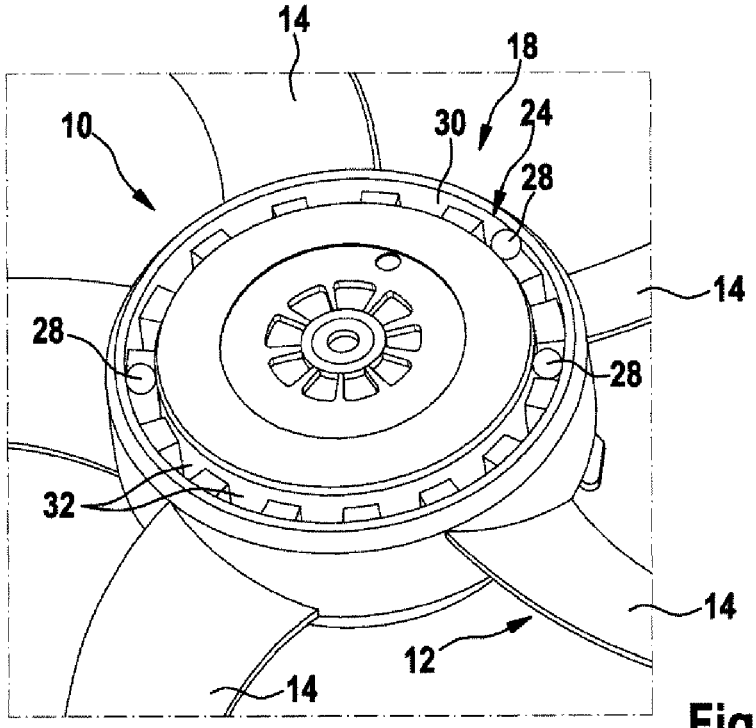
FIG. 4 shows a detail of a perspective view of an engine fan device according to a second embodiment of the invention.

FIG. 4 represents a second embodiment of the engine fan device 10 according to the invention. Here the second embodiment differs from the first embodiment in FIGS. 1 to 3 in that, for example, two or more balancing elements 28 are arranged in the same plane of rotation 26, in this case the plane of rotation A, for example, whilst one, two or more balancing elements 28, in this case a third balancing element 28, for example, are arranged in the other plane of rotation 26, in this case the plane of rotation B, for example. Here the material composition, for example, and the weight of at least two or more of the balancing elements 28 differ.

Figure 5:
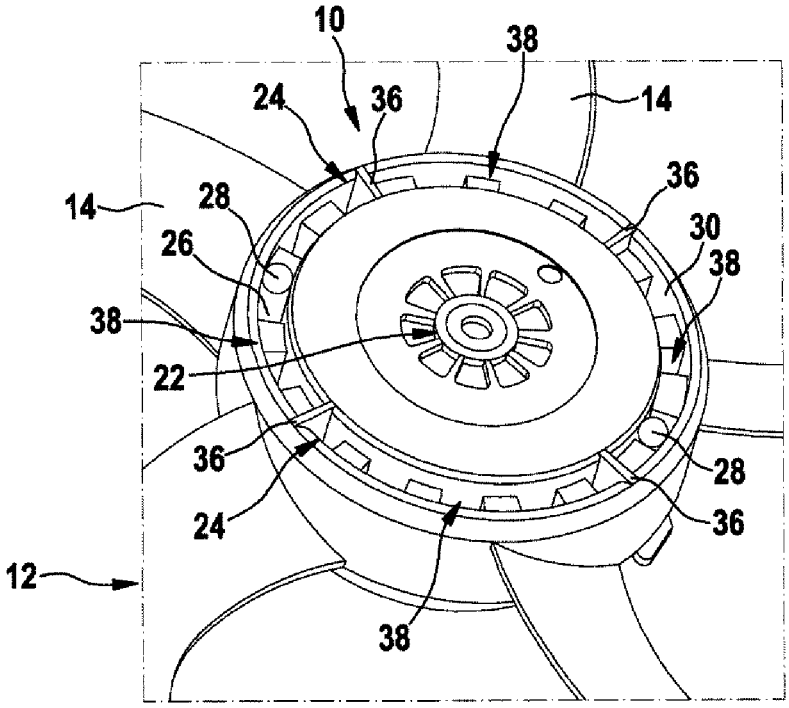
FIG. 5 shows a detail of a perspective view of an engine fan device according to a third embodiment of the invention.

FIG. 5 shows a perspective view of an engine fan device 10 according to a third embodiment of the invention. In this embodiment the mounting contour 24, here in the form of a groove 30, is formed around the circumference, one, two, three or more ribs 36 being provided, which interrupt the course of the groove 30 and the mounting contour 24. The ribs 36 may serve, for example, to divide a mounting contour 24 into multiple chambers 38, which are capable of accommodating one, two or more balancing elements 28, the chambers 38 here forming one, two or more planes 26. In the example in FIG. 5 the four chambers 38 each have both planes of rotation A and B, for example. The four chambers 38 may here have the same or a different number of depressions 32 for the mounting of balancing elements 28.

Figure 6:
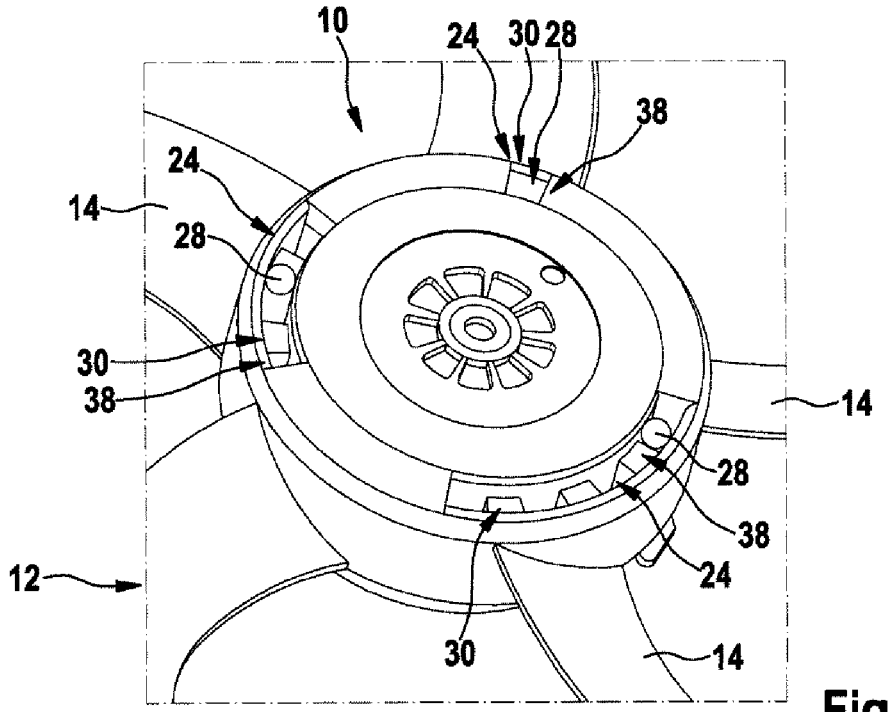
FIG. 6 shows a detail of a perspective view of an engine fan device according to a fourth embodiment of the invention.

FIG. 6 also shows an engine fan device 10 according to a fourth embodiment of the invention. Here the engine fan device 10 or the fan appliance 12 likewise has a mounting contour 24 in the form of a groove 30, which is arranged in the hub area 18 of the engine fan device 10. Here, however, in contrast to the first, second and third embodiments, the groove 30 is only designed to run over part of the circumference. In other words, the mounting contour 24 may comprise one, two, three or more grooves 30 running round part of the circumference. These may be arranged, for example, in a ring, for example a concentric ring, as shown in FIG. 6. These grooves 30 running round part of the circumference may also be positioned on rings (not shown) arranged in series, however. The grooves 30 running round part of the circumference, as shown in FIG. 6, form different chambers 38 having one, two or more planes 26. The three chambers 38 here may accommodate a different number of balancing elements 28, for example. Thus one chamber 38 may accommodate only one balancing element 28 in one plane of rotation B. The other two chambers 38 may accommodate different numbers of balancing elements 28, in the planes of rotation A and B.

Figure 7:
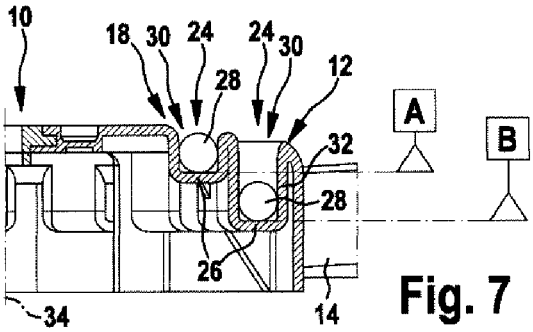
FIG. 7 shows a sectional view of an engine fan device according to a fifth embodiment of the invention.

FIG. 7 shows a partial sectional view of an engine fan device 10 according to a fifth embodiment of the invention. Here the engine fan device 10 or its fan appliance 12 has at least two mounting contours 24, which are arranged side by side running over part or all of the circumference, in this case in the hub area 18 of the engine fan device 10 or its fan appliance 12. The mounting contours 24 form two grooves 30, for example, which are arranged in the form of two concentric circles. Each of the mounting contours 24 or grooves 30 here has at least one or more planes 26 or planes of rotation 26. The first, inner groove 30 forms the plane of rotation A, for example, and the second, outer groove 30 forms the plane of rotation B. In principle, however, any of the mounting contours 24 may also alternate between at least two, three and more planes 26, as in the preceding embodiments. At the same time one, two, three or more balancing elements 28 may be provided in one or both mounting contours 24.

Figure 8:
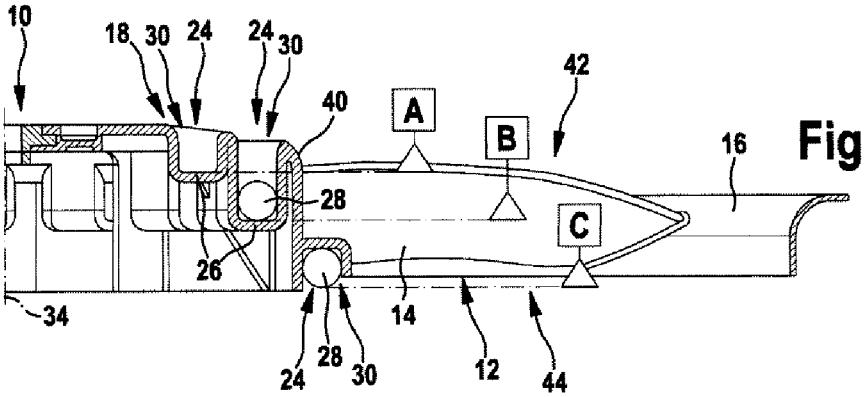
FIG. 8 shows a sectional view of an engine fan device according to a sixth embodiment of the invention.

FIG. 8 also shows a partial sectional view of an engine fan device 10 according to a sixth embodiment of the invention. Here the sixth embodiment is based substantially on the fifth embodiment. In this case, however, at least one, two or more mounting contours 24 are provided adjoining the hub area 18 or the inner end 40 of the blade elements 14 of the fan appliance 12. Here the mounting contours 24 may be oriented towards the upper side 42 and/or the underside 44 of the engine fan device 10. This mounting contour 24 or these mounting contours 24 may also form at least one further plane 26, for example a plane of rotation C, in which at least one, two, three or more balancing elements 28 can be mounted. The plane of rotation C may be situated higher or lower than the planes of rotation A and B, for example.

Figure 9:
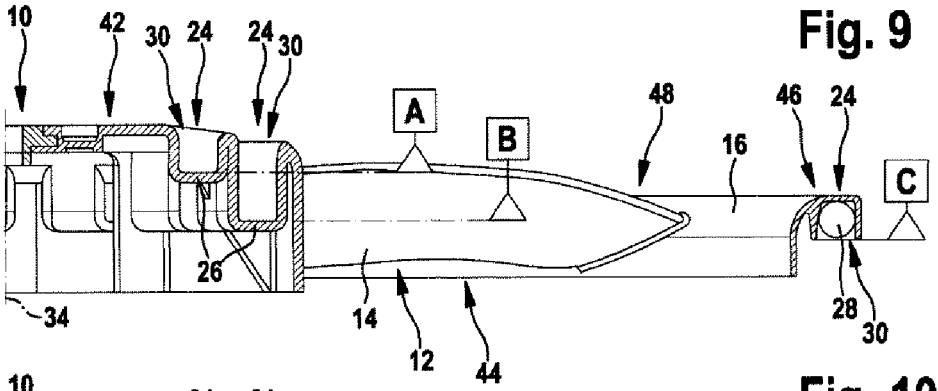
FIG. 9 shows a sectional view of an engine fan device according to a seventh embodiment of the invention.

FIG. 9 further represents a partial sectional view of an engine fan device 10 according to a seventh embodiment of the invention. Here the seventh embodiment is based on the fifth embodiment according to FIG. 7. In the seventh embodiment, however, at least one, two or more mounting contours 24 are additionally provided on the upper side and/or the underside 42, 44 of the fan appliance 12, this time on the outside 46 of the fan appliance 12 or the outside 46 of the fan wheel 16. Here this mounting contour 24 or these mounting contours 24 may form at least one further plane 26, for example a plane of rotation C, in which at least one, two, three or more balancing elements 28 can be mounted. The plane of rotation C may be situated higher or lower than the planes of rotation A and B, for example. As in the other embodiments the mounting contour 24, for example, may take the form of a groove 30, for example a groove 30 running around part or all of the circumference.

Figure 10:
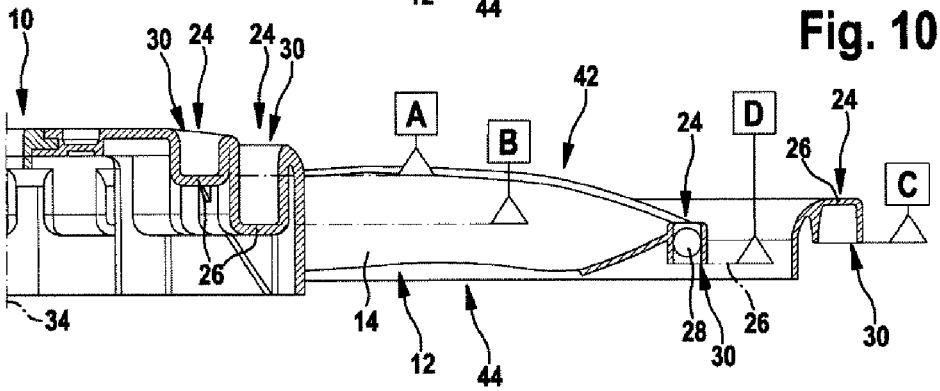
FIG. 10 shows a sectional view of an engine fan device according to an eighth embodiment of the invention.

FIG. 10 now shows a partial sectional view of an engine fan device 10 according to an eighth embodiment of the invention. Here the eighth embodiment is based on the seventh embodiment, the eighth embodiment besides at least one mounting contour 24 on the outside 46 of the fan wheel 16 additionally having at least one, two or more mounting contours 24 on the inside 48 of the fan wheel 16. Here the mounting contours 28 may be oriented towards the upper side 42 and/or the underside 44 of the engine fan device 10 or the fan appliance 12. In addition the respective mounting contour 24, as shown in FIG. 10, may have at least one, two or more planes 26 or planes of rotation 26, for mounting one, two or more balancing elements 28. In FIG. 10, for example, one mounting contour 24 is provided on the inside 48 of the fan wheel 16, the mounting contour 24, for example in the form of a groove 30, being arranged on the underside 44 of the fan appliance 12 and forming a plane of rotation D, which is situated lowest, for example. In this case at least one or more balancing elements 28, for example, are arranged in the groove 30.

Figure 11:
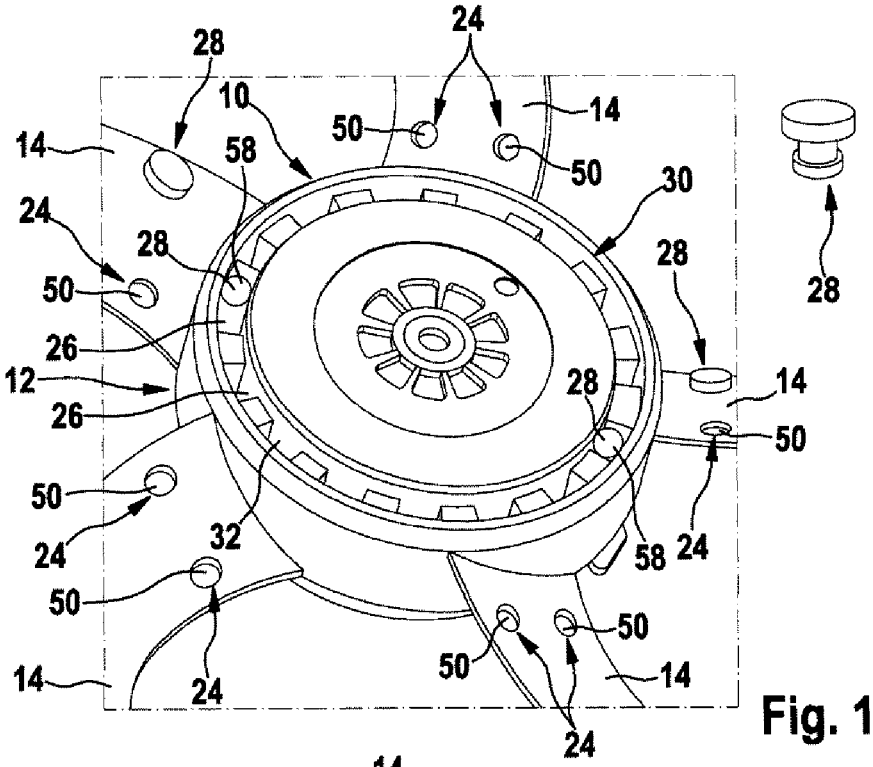
FIG. 11 shows a detail of a perspective view of an engine fan device according to a ninth embodiment of the invention.

FIG. 11 now shows a detail of a perspective view of an engine fan device 10 according to a ninth embodiment of the invention. In this embodiment the respective mounting contour 24 takes the form of an opening 50, for example a circular opening 50. Here a balancing element 28 in the form of a rivet element 52 is fixed in the opening 50. More precisely the balancing element 28, in this case the rivet element 52, for example, is externally enclosed by the fan geometry. In principle the respective opening 50 as mounting contour 24 or fixing contour may have any shape, that is to say it may be circular, oval and/or angular, for example. The mounting contours 24 or openings 50 here are formed in at least one or more of the blade elements 14 of the fan appliance 12. In this case the mounting contours 24 may be arranged, for example, on the same radius around the axis of rotation 34 of the engine fan device 10 or the fan appliance 12, but on different levels, as is indicated in FIG. 11, in order to form various planes 26. However, the mounting contours 24 could also be arranged on different radii around the plane of rotation 34 and in addition could here be on different levels and/or at the same level.

Here, besides rivet elements 52, mushroom-shaped elements 54, pin elements 56 or other balancing elements 28 of any shape, for example, which can be fixed in a respective opening 50, could also be provided as balancing elements 28. In this case at least one, two or more mounting contours 24 in the form of openings 50, which can be fitted with balancing elements 28, may be provided in at least one, two or more blade elements 14. At the same time the ninth embodiment may also be combined with the other embodiments, with the first or second embodiment, for example, as shown in FIG. 10. Here, in addition to the mounting contours 24 in the form of openings 50 in the blade elements 14, at least one, two or more mounting contours 24 in the form of grooves 30 are also provided on the fan appliance 12. A groove 30 here has two planes of rotation 26, for example, in which balancing elements 28, for example in the form of balls 58, can be mounted.

Figure 12:
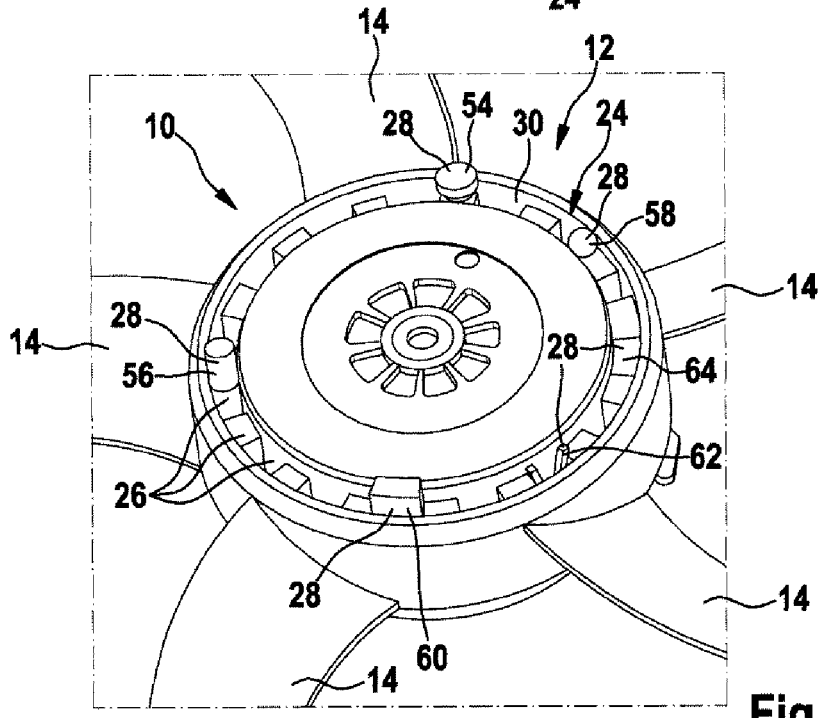
FIG. 12 shows a detail of a perspective view of an engine fan device according to a tenth embodiment of the invention.
Figure 13:
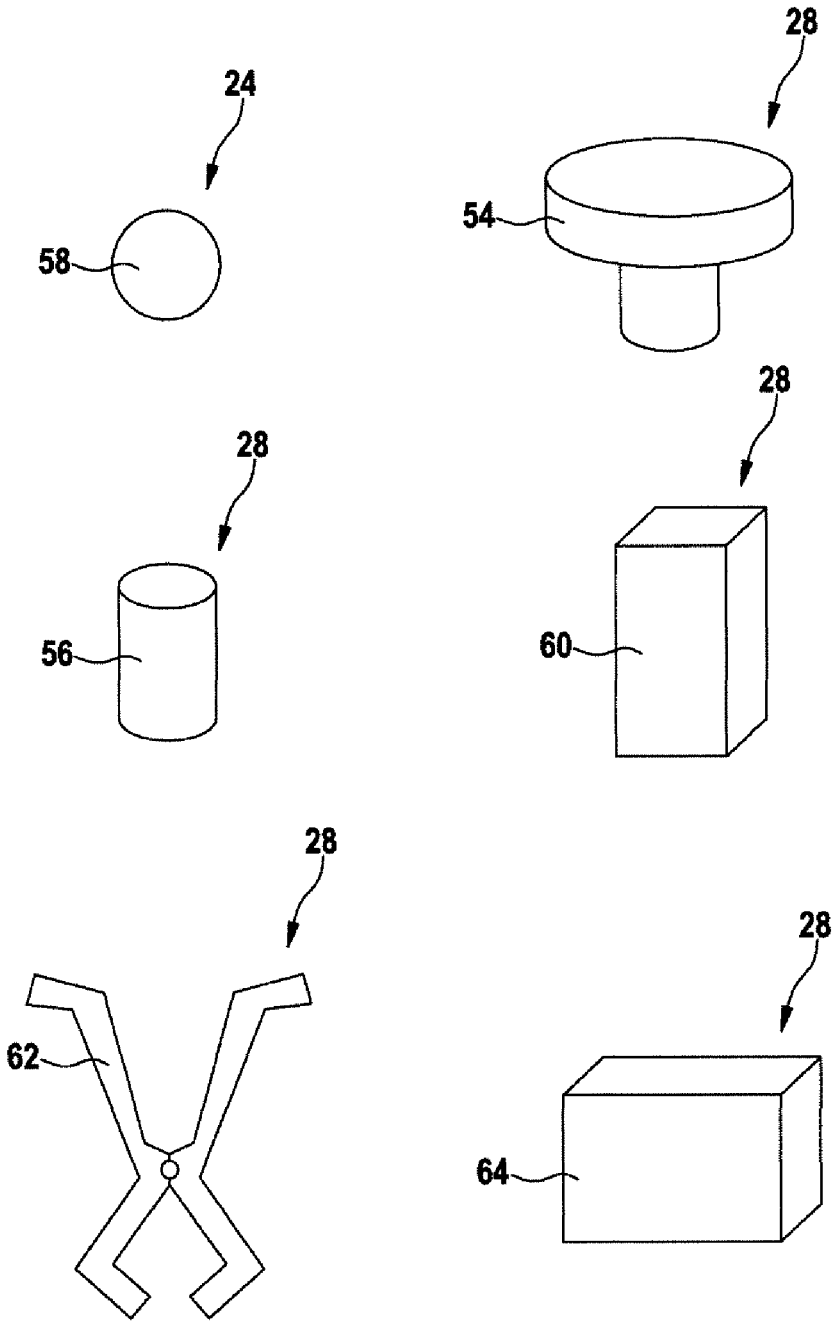
FIG. 13 shows various embodiments for a balancing element.

FIG. 12 further shows a detail of a perspective view of an engine fan device 10 according to a tenth embodiment of the invention. The tenth embodiment of the invention is comparable to the first and second embodiments. In this case one, two or more mounting contours 24 are provided, for example in the form of grooves 30 running round part or all of the circumference. The groove 30 represented in FIG. 12 has two planes 26 or planes of rotation 26, for example. The second, lower plane 26 here takes the form of a multiple mounts or depressions 32, in which balancing elements 28 can be mounted. On the one hand spherical balancing elements 58, which are externally clamped in the mount or the groove 30, may be provided as balancing elements 28, as shown in FIGS. 12 and 13. Alternatively or in addition, a mushroom-shaped element 54, which is likewise externally clamped in order to fix it in the mounting contour 24, may also be provided as balancing element 28. In this case the mushroom-shaped element 58 is inserted by its shank portion, for example, into the groove 30 and externally enclosed by the latter. Correspondingly a cylindrical element 56, which is inserted into the groove 30 and externally clamped by the groove 30, may also be used as balancing element 28. Furthermore, instead of the cylindrical element 56, a rectangular block element 60 or a polygonal element, for example, may also be used as balancing element 28 and inserted into the groove 30, where it is externally clamped. In addition an expanding spring element 62, for example, may also be used as balancing element 28. This is inserted into the groove 30 where it is externally clamped. In addition a casting compound 64 may also be used as balancing element 28, the casting compound 64 being circumferentially enclosed by a mount of the groove 30, for example. However, these are only examples of balancing elements 28 which can be externally clamped or circumferentially enclosed in the respective mounting contour 24 in the form of a groove 30, for example, or an opening 50. The invention is not limited to these balancing elements. The balancing elements 28 are cited merely by way of example. Common to the balancing elements 28 is the fact that around the circumference or at a minimum of two points they are externally held or enclosed, for example by pre-tightening and/or adhesive bonding, by the special mounting contour 24 incorporated in the fan appliance 12. This applies to all embodiments of the invention. Here the balancing elements 28 may be used with one another in any combination and have the same weight or a different weight, for example, depending on the function and intended purpose.

Figure 14:
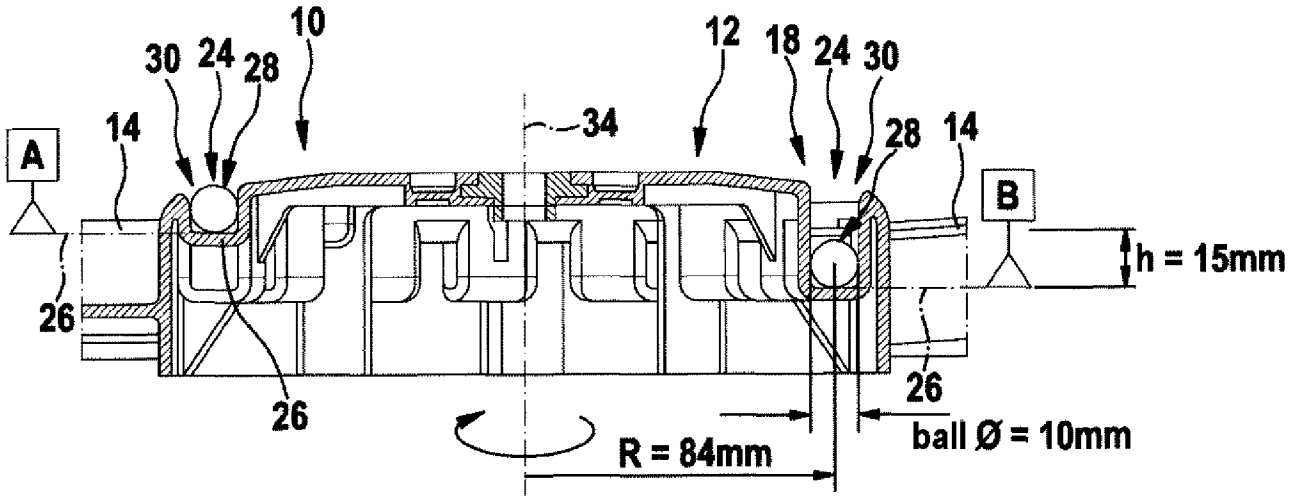
FIG. 14 shows a sectional view of an engine fan device according to the first embodiment defining the maximum unbalance compensation.

FIG. 14 further shows a sectional view of the engine fan device 10 according to the first embodiment defining a maximum unbalance compensation. In this case a mounting contour 24 is provided in the hub area 18 of the fan appliance 12. Here the mounting contour 24 takes the form of a groove 30, for example, having two planes of rotation A and B, the plane of rotation B being separated from the plane of rotation A by a distance h=15 mm. The groove 30 itself has a diameter of R=84 mm, measured from the axis of rotation 34. In addition two balancing elements 28 are provided in the form of balls 58, for example, which each have a diameter of 10 mm and are arranged on opposite sides in the plane of rotation A and the plane of rotation B, as shown in FIG. 14.

The maximum dynamic unbalance compensation is then:

$$= m \cdot R \cdot h = \left(\frac{4}{3} \cdot r^3 \cdot Pi \cdot \rho\right) \cdot R \cdot h =$$

$$\frac{4}{3} \cdot (5\ \text{mm})^3 \cdot Pi \cdot 7.8\ \text{g/cm}^3 \cdot 84\ \text{mm} \cdot 15\ \text{mm} = \approx 5000\ \text{gmm}^2$$

According to the invention previously described with reference to various embodiments the engine fan device 10 has a special mounting contour 24 or mounting contours 24 integrated in the fan appliance 12. These mounting contours 24 in each case serve for fixing balancing masses 28 in different planes of rotation 26, preferably perpendicularly to the fan axis of rotation 34. Metal or metallic balancing weights 28, for example, are fixed into these mounting contours 24. Here the metal content of the balancing weights 28 is 25 to 100% by weight, for example. The balancing weights or balancing elements 28 themselves produce a dynamic unbalance in rotation about the fan axis of rotation 34 of >400 gmm$^2$, as has previously been shown from the example of FIG. 14, which serves to reduce the overall dynamic unbalance of the fan. All around the circumference or at a minimum of two points the balancing weight or the balancing element 28 is externally held or enclosed, for example by pre-tightening and/or adhesive bonding, by means of the special mounting contour 24.

Incorporating two, three and more mounting contours 24 into the fan appliance 12 for fixing balancing elements 28 or balancing masses in different planes of rotation 26 for the first time affords a technically simple way of automatically balancing the dynamic unbalance of engine cooling fans 10. A method for automatically attaching balancing masses by pressing in or injecting balls, for example, to compensate for the static unbalance, can be adapted for automated compensation of the dynamic unbalance. It is likewise feasible to bond heavy, for example metallic, casting compounds in these contours 24 and thereby to balance the dynamic unbalance of the fan 10. Use of the invention makes it possible to substantially eliminate the deficiencies described in respect of the state of the art and thereby to achieve a considerable technical competitive advantage. The embodiments previously described and in particular individual features may be combined with one another. In the case of the balancing elements 28, balancing elements 28 of the same weight, material and/or shape, or with at least two or more or all balancing elements 28 of differing shape, material and/or weight may be used in the individual embodiments. In addition mounting contours 24 in the form of openings 50 may be provided not only on blade elements 14 of the fan wheel 16 but also, for example, on the fan wheel 16 itself and/or on the hub area 18 of the fan appliance 12.

What is claimed is:

1. An engine fan device for a vehicle, characterized in that the engine fan device (10) has one or more mounting contours (24, 30, 50) in which one or more balancing elements (28) are mounted, the one or more mounting contours (24, 30, 50) forming two planes (26) that are different from one another, the one or more balancing elements (28) being mounted to the one or more mounting contours (24, 30, 50) along the two planes (26) such that the one or more balancing elements (28) do not move relative to the one or more mounting contours (24, 30, 50).

2. The engine fan device as claimed in claim 1, characterized in that the one or more mounting contours (24) are embodied in the form of at least one or more grooves (30) that run around at least a portion of a circumference of the fan device.

3. The engine fan device as claimed in claim 1, characterized in that the two planes (26) are planes of rotation.

4. The engine fan device as claimed in claim 1, characterized in that one of the one or more mounting contours (24) is arranged in a hub area (18) of a fan appliance (12) of the engine fan device (10) and one of the one or more mounting contours (24) is arranged on an outside (46) of a fan wheel (16) of the fan appliance (12) and one of the one or more mounting contours (24) is arranged adjoining the hub area (18) and one of the one or more mounting contours (24) is arranged at an outer end of a blade element (14).

5. The engine fan device as claimed in claim 1, characterized in that one of the one or more mounting contours (24) is in the form of a groove (30) that runs around at least a portion of a circumference of the fan device, the groove (30) being divided by one or more ribs (36) in order to form one or more chambers (38) in which the one or more balancing elements (28) are mounted.

6. The engine fan device as claimed in claim 1, characterized in that the one or more mounting contours (24, 30, 50) includes multiple mounting contours (24) in the form of grooves (30) arranged in a circle around an axis of rotation (34), the multiple mounting contours (24) comprising chambers (38) in which the at least one or more balancing elements (28) are mounted.

7. The engine fan device as claimed in claim 1, characterized in that a fan appliance (12) of the engine fan device (10) comprises at least one or more blade elements (14), at least one of the blade elements (14) having openings (50) in which at least one of the one or more balancing element (28) is mounted.

8. The engine fan device as claimed in claim 1, characterized in that the one or more balancing elements (28) are selected from a group consisting of a spherical element (58), a rivet element (52), a mushroom-shaped element (54) a pin element (56) or a cylindrical element, an expanding spring element (62), a rectangular block element (60) and a casting compound (64).

9. The engine fan device as claimed in claim 8, wherein the one or more mounting contours (24) is selected from a group consisting of a groove (30) and an opening (50).

10. The engine fan device as claimed in claim 8, wherein the one or more mounting contours (24) is an opening (50) of circular design.

11. The engine fan device as claimed in claim 1, characterized in that one of the one or more balancing elements (28) is externally clamped and fixed thereby to the one or more mounting contours (24, 30, 50).

12. The engine fan device as claimed in claim 1, characterized in that two of the one or more balancing elements (28) are of different design in respect of their shape, dimensions, weight and/or material.

13. The engine fan device as claimed in claim 12, wherein the one or more balancing elements (28) is made of metal or metallic.

14. The engine fan device as claimed in claim 12, wherein the one or more balancing elements (28) is metallic, having a metal content of 25 to 100% by weight.

15. The engine fan device as claimed in claim 1, wherein the engine fan device has an axis of rotation, and the two planes (26) are perpendicular to the axis of rotation.

16. The engine fan device as claimed in claim 1, characterized in that the two planes (26) are planes of rotation and the one or more mounting contours (24) are arranged concentrically around an axis of rotation (34) of the engine fan device (10).

17. The engine fan device as claimed in claim 1, wherein the one or more balancing elements (28) are mounted to the one or more mounting contours (24, 30, 50) with adhesive.

18. The engine fan device as claimed in claim 1, wherein the engine fan includes three mounting contours (24, 30) forming three planes (26), each of the three planes (26) being different, the one or more balancing elements (28) being mounted to the three mounting contours (24, 30) along the three planes (26).

19. The engine fan device of claim 18, wherein one of the one or more mounting contours (30) is disposed at an inner end (40) of a blade element (14).

20. The engine fan device of claim 1, wherein one of the mounting contours (30) is open in a first direction, and two of the other mounting contours (24) are open in an opposite direction.

21. The engine fan device of claim 1, wherein the two planes (26) are fixed axially.

22. The engine fan device of claim 1, wherein the two planes (26) are stationary relative to a hub area (18).

* * * * *